US011634978B2

(12) United States Patent
Goldsmith

(10) Patent No.: US 11,634,978 B2
(45) Date of Patent: Apr. 25, 2023

(54) METHODS FOR RECOVERING A MINERAL FROM A MINERAL-BEARING DEPOSIT

(71) Applicant: CANATECH MANAGEMENT SERVICES INC., Chilliwack (CA)

(72) Inventor: Elmar Goldsmith, Chilliwack (CA)

(73) Assignee: CANATECH MANAGEMENT SERVICES INC., Chilliwack (CA)

( * ) Notice: Subject to any disclaimer, the term of this patent is extended or adjusted under 35 U.S.C. 154(b) by 33 days.

(21) Appl. No.: 17/177,606

(22) Filed: Feb. 17, 2021

(65) Prior Publication Data

US 2021/0254445 A1 Aug. 19, 2021

Related U.S. Application Data

(60) Provisional application No. 62/978,052, filed on Feb. 18, 2020.

(51) Int. Cl.
*E21B 43/28* (2006.01)
*E21B 43/30* (2006.01)
*E21B 43/29* (2006.01)

(52) U.S. Cl.
CPC ..... *E21B 43/283* (2013.01); *E21B 43/28* (2013.01); *E21B 43/305* (2013.01); *E21B 43/29* (2013.01)

(58) Field of Classification Search
CPC ..... E21B 43/28; E21B 43/283; E21B 7/046; E21B 43/29; E21B 43/30; E21B 43/305
See application file for complete search history.

(56) References Cited

U.S. PATENT DOCUMENTS 2,161,800 A 6/1939 Cross
2,682,396 A * 6/1954 Haworth ..... E21B 43/28 299/5
2,847,202 A 8/1958 Pullen, Jr. et al.
3,148,000 A 9/1964 Dahms et al.
3,501,201 A * 3/1970 Closmann ..... E21B 43/281 299/5
8,899,691 B2 12/2014 Day et al.
9,260,918 B2 2/2016 Day et al.
(Continued)

FOREIGN PATENT DOCUMENTS

WO WO-2018049368 A1 * 3/2018 ..... E21B 43/305

OTHER PUBLICATIONS

Canada Office Action dated Jul. 15, 2022, for Canadian Application No. 3,109,397 filed Feb. 17, 2021, 4 pages.

*Primary Examiner* — Abby J Flynn
*Assistant Examiner* — Michael A Goodwin

(57) ABSTRACT

The disclosure provides methods and systems for recovering a target mineral from a mineral-bearing deposit. One or more first wells and one or more second wells are drilled into the deposit, each well having a substantially vertical section and a substantially horizontal section, the horizontal section of the second wells located above the horizontal section of the first wells. At least one channel from the horizontal section of each first well toward the horizontal section of the second wells is established. A fluid is injected into the deposit from the horizontal section of the first wells to form one or more slots. A brine is recovered from the horizontal section of the second wells, forming a cavity. A salt solution is then injected into the cavity from the horizontal section of the second wells and a target mineral-enriched solvent is recovered from the first wells.

20 Claims, 11 Drawing Sheets

(56) References Cited

U.S. PATENT DOCUMENTS

| | | | | |
|---|---|---|---|---|
| 2011/0127825 | A1* | 6/2011 | Hughes | E21B 43/28 299/4 |
| 2012/0292026 | A1* | 11/2012 | Brooks | E21B 43/305 166/270.1 |
| 2014/0054032 | A1* | 2/2014 | Affholter | E21B 43/247 166/272.6 |
| 2014/0124194 | A1* | 5/2014 | Jorshari | E21B 43/305 166/305.1 |
| 2014/0367097 | A1* | 12/2014 | Milam | E21B 43/25 166/57 |
| 2016/0123096 | A1* | 5/2016 | Mathieson | E21C 41/16 175/50 |
| 2017/0152730 | A1* | 6/2017 | Modavi | E21B 49/00 |
| 2019/0368330 | A1* | 12/2019 | Hardage | E21B 43/2405 |
| 2021/0032970 | A1* | 2/2021 | Li | E21C 41/16 |

* cited by examiner

METHODS FOR RECOVERING A MINERAL FROM A MINERAL-BEARING DEPOSIT

FIELD

This disclosure relates to methods and systems for solution mining a target mineral in a mineral-bearing deposit. In particular, the disclosure relates to methods and systems for solution mining a target mineral in a mineral-bearing deposit by increasing the available or mineable surface area in the deposit.

BACKGROUND

Potash is a salt that contains potassium in water-soluble form, for example, potassium chloride. A large percentage of the occurrences of "potash" are natural deposits of sylvinite. Sylvinite, an association of halite (NaCl) and sylvite (KCl), is found in deposits often deep below the surface. Sylvinite deposits typically comprise from about 15% to about 45% KCl. Beds of sylvinite are often sandwiched between layers of more or less potash-free salt in a deposit. More than one bed of sylvinite separated by salt beds is common and the composition of each sylvinite bed may vary substantially from those above and below. Even within a bed, the potash content may vary from top to bottom of the bed. Within the salt and sylvinite beds there may also be relatively thin layers of clay and other soluble and insoluble minerals.

There are large sylvinite deposits in the United States, particularly in North Dakota, Michigan, Utah and New Mexico, and western Canada, particularly in Saskatchewan. These deposits are often about 3,000 feet to about 8,000 feet below the surface. Other potential reserves are deeper or closer to the surface. The saline layer (mixed layers of sylvinite and salt) may vary in thickness from several feet to about 500 feet. The sylvinite ore lies in one or more beds ranging in thickness from about 10 feet to about 70 feet. The ore is often overlain with one or more aquifers or porous strata containing water.

Deposits shallower than about 3,500 feet are usually exploited by conventional shaft mining. Deposits greater than about 3,500 feet cannot be exploited by shaft mining due to instability of the rock at this depth and pressure, and the cost and risks of sinking a shaft through the aquifer(s) to them, and must be exploited by solution mining. In solution mining, a solution mining cavity is normally established at a convenient level within the deposit to be mined, as is known to a person of ordinary skill in the art. The feed to the solution mining cavity, also referred to as the extracting solution, the aqueous solvent, the solvent, the aqueous extracting solution or the feed, may be either substantially pure water or a dilute aqueous solution of sodium chloride, a dilute aqueous solution of potassium chloride or a dilute aqueous solution of potassium chloride and sodium chloride. As the feed of solvent is introduced to the cavity, it dissolves potassium chloride and sodium chloride from the strata forming the cavity walls, and forming a working solution. When a solvent that is dilute in potassium chloride and rich in sodium chloride is fed to a cavity in contact with KCl strata, an effluent solution will be recovered containing a substantially higher ratio of KCl to NaCl than the solvent. The effluent is withdrawn from the cavity to the surface. At the surface, the KCl is concentrated and recovered. This may be accomplished by feeding the effluent to an evaporation pond, a cooling pond, or to an evaporator-crystallizer circuit where KCl is recovered from the cavity effluent.

The techniques described above have multiple variations, for example, one or more wells may be sunk into the saline layer. Where two spaced-apart wells are sunk, several techniques have been used to develop communication between the bottoms of the wells so that solvent may be pumped down one well and enriched solvent recovered up through the other. In some instances, the subterranean formations may be fractured by hydraulic pressure, that is, by lifting the overburden and the saline deposit to create a passage at the base of the saline deposit (see, for example, U.S. Pat. No. 2,847,202). In extremely deep saline beds, hydraulic fracturing is difficult and the communication may be established by solution mining the underlying salt deposits at the base of each bore until the cavities created thereby are joined (see, for example, U.S. Pat. No. 3,096,969). Once communication has been established, fresh water or brine is pumped down to the saline layer and back up to the surface as a brine enriched with KCl. On the surface, the KCl can be precipitated and crystallized from the brine by cooling.

It is desirable to increase the potash loading of the solvent from a potash mine. The KCl loading of the solvent is dependent upon the solubilities of salt and potash in water. These are interdependent and temperature dependent. However, in general, the rate at which salt enters solution is greater than the rate at which potash enters solution. This is due to the relative amounts of each present in the ore. Several techniques have been suggested for increasing the KCl loading of solvents from sylvinite deposits. The temperature of the solvent can be increased, thereby increasing the theoretical KCl loading of the brines (see, for example, U.S. Pat. No. 2,161,800). While this has been suggested for some time, it has not been commercially practical in normal cavities. Selective mining of KCl by introducing solvent saturated in NaCl or by allowing a portion of the brine in the cavern to become saturated with NaCl while still in contact with KCl-rich ore below the point of NaCl saturation has also been suggested as another method to increase the potash loading of the effluent. Increasing the residence time of the brine in the cavity is impractical due to the very slow rate of selective mining on the sidewalls of a normal cavity. Finally, it has been suggested to increase the surface area exposed to the solvent by creating a rubble pile of KCl-rich ore on the floor of the cavity resulting from staged caving of the cavity roof (see, for example, U.S. Pat. No. 3,148,000).

Thus, there remains a need for methods and systems to increase the target mineral loading of a extraction solvent used for solution mining a mineral-bearing deposit, such as the KCl loading of solvents from sylvinite deposits.

SUMMARY

In various aspects, the present disclosure is directed to methods for recovering a target mineral from a mineral-bearing deposit, the methods comprising: drilling one or more first wells and one or more second wells in the mineral-bearing deposit, the one or more first wells and the one or more second wells each having a substantially vertical section and a substantially horizontal section, the horizontal section of the one or more second wells vertically off-set from the horizontal section of the one or more first wells, the horizontal section of the one or more second wells above the horizontal section of the one or more first wells as viewed from a longitudinal-elevation side-view; establishing at least one channel from the horizontal section of each of the one or more first wells toward the horizontal section of the one or more second wells; injecting a fluid into the mineral-bearing formation from the horizontal section of the one or more first wells adjacent to each of the at least one channels to form one or more slots; recovering brine from the deposit through the horizontal section of the one or more second wells to form a cavity in the deposit; injecting a salt solution into the cavity from the horizontal section of the one or more second wells to cause selective dissolution of the target mineral; recovering a target mineral-enriched solvent from the horizontal section of the one or more first wells; and recovering the target mineral from the target mineral-enriched solvent.

In various aspects, the present disclosure is directed to systems for recovering a target mineral from a mineral-bearing deposit, the systems comprising: one or more first wells and one or more second wells in the mineral-bearing deposit, the one or more first wells and the one or more second wells each having a substantially vertical section and a substantially horizontal section, the horizontal section of the one or more second wells vertically off-set from the horizontal section of the one or more first wells, the horizontal section of the one or more second wells above the horizontal section of the one or more first wells as viewed from a longitudinal-elevation side-view; at least one channel extending from the horizontal section of each of the one or more first wells toward the horizontal section of the one or more second wells; a fluid for injecting into the mineral-bearing deposit from the horizontal section of the one or more first wells adjacent to each of the at least one channels to form one or more slots, wherein the fluid dissolves salt and brine is recovered from the mineral-bearing deposit through the horizontal section of the one or more second wells, thereby forming a cavity in the mineral-bearing deposit; and a salt solution for injecting into the cavity from the horizontal section of the one or more second wells to selectively dissolve the target mineral and form a target mineral-enriched solvent that is recovered from the horizontal section of the one or more first wells, wherein the target mineral is recovered from the target mineral-enriched solvent.

In various embodiments, the horizontal section of the one or more second wells is laterally off-set from the horizontal section of the one or more first wells, as viewed from a lateral-elevation side-view.

In various embodiments, the fluid is injected into the mineral-bearing deposit in a direction perpendicular to the horizontal section of the one or more first wells.

In various embodiments, each of the one or more slots extends vertically from the horizontal section of the one or more first wells.

In various embodiments, the target mineral is potash.

In various embodiments, the at least one channel is a directionally drilled borehole.

In various embodiments, the mineral-bearing deposit is hydro-fractured from the horizontal section of the one or more first wells, wherein the at least one channel is a fracture.

In various embodiments, each of the at least one channels is in communication with the horizontal section of one of the one or more first wells and the horizontal section of one of the one or more second wells.

In various embodiments, one first well and one second well are drilled in the mineral-bearing deposit.

In various embodiments, two first wells and one second well are drilled in the mineral-bearing deposit.

In various embodiments, the second well is laterally between the two first wells as viewed from a longitudinal-elevation side-view.

In various embodiments, three first wells and one second well are drilled in the mineral-bearing deposit, one of the three first wells substantially underneath the second well as viewed from a longitudinal-elevation side-view.

In various embodiments, the one or more second wells is at or adjacent to a top of the mineral-bearing deposit.

In various embodiments, the one or more first wells is at or adjacent to a bottom of the mineral-bearing deposit.

In various embodiments, a heel of the one or more first wells is below the bottom of the mineral-bearing deposit.

In various embodiments, the fluid for forming the one or more slots comprises water.

In various embodiments, the fluid for forming the one or more slots consists of water.

In various embodiments, the fluid for forming the one or more slots does not include a roof control fluid.

In various embodiments, two or more channels are established in the deposit and portions of the cavity from the two or more channels are non-communicating.

In various embodiments, the salt solution is a saturated or near-saturated salt solution. For example, the salt solution may be a saturated or near-saturated NaCl solution.

In various embodiments, the vertical sections of the one or more first wells and the one or more second wells are drilled on a same side of the mineral-bearing deposit.

In various embodiments, the vertical sections of the one or more first wells and the one or more second wells are drilled on opposite sides of the mineral-bearing deposit.

In various embodiments, the horizontal sections of the one or more first wells and the one or more second wells are parallel as viewed from the longitudinal elevation view.

In various aspects, the present disclosure is directed to a target mineral recovered from a mineral-bearing deposit by a method or using a system as disclosed herein.

Other aspects and features of the present invention will become apparent to those of ordinary skill in the art upon review of the following description of specific embodiments of the invention in conjunction with the accompanying claims.

BRIEF DESCRIPTION OF THE DRAWINGS

In drawings which illustrate embodiments of the disclosure.

DETAILED DESCRIPTION

Figure 1:
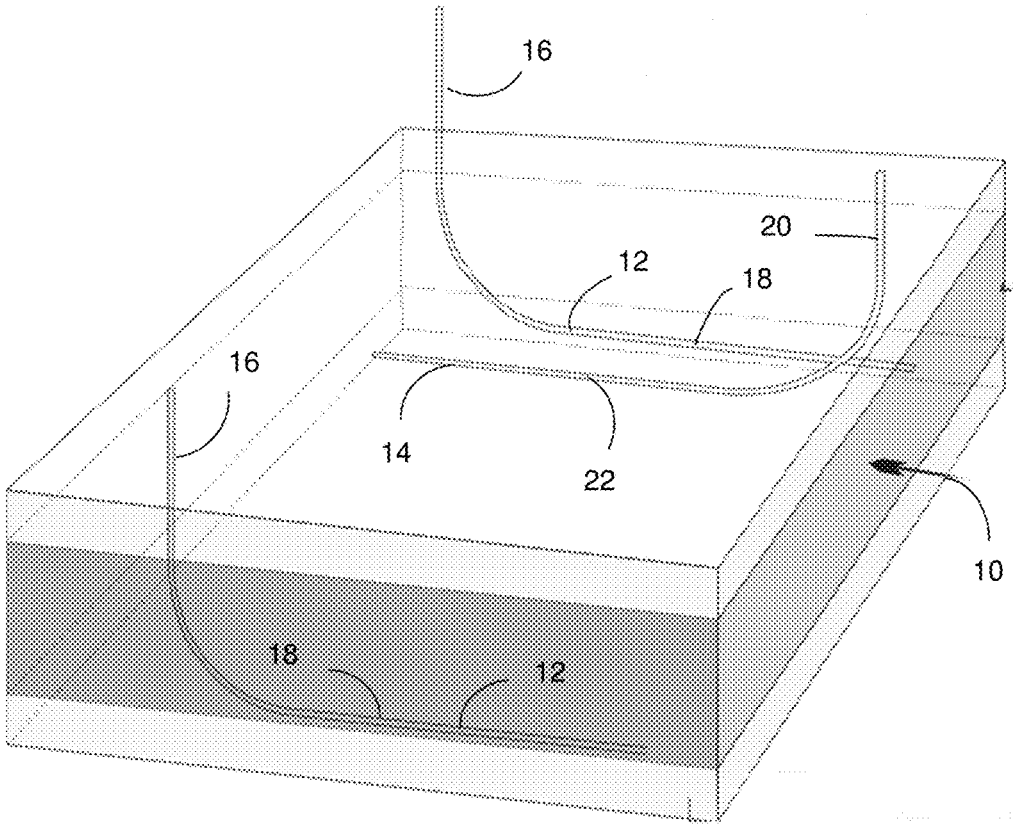
FIG. 1 is a perspective view of a well arrangement for a method according to an embodiment of the invention.

In the context of the present disclosure, various terms are used in accordance with what is understood to be the ordinary meaning of those terms.

The term "potash" refers to potassium chloride.

Disclosed embodiments include solution mining methods and systems for selectively mining a target mineral from a mineral-bearing deposit by increasing a mineable surface area in the deposit. The target mineral may be potash or other minerals such as carnallite, or langbeinite, amongst others. In various embodiments, recovery of the target mineral is increased compared to previous methods as the methods described herein increase the available or mineable surface area in the deposit. By increasing the available or mineable surface area in the deposit, there is an increased area from which the target mineral can be dissolved.

In various embodiments, the methods described herein for recovering a target mineral from a mineral-bearing deposit comprise: drilling one or more first wells and one or more second wells in the mineral-bearing deposit, the one or more first wells and the one or more second wells each having a substantially vertical section and a substantially horizontal section, the horizontal section of the one or more second wells vertically off-set from the horizontal section of the one or more first wells, the horizontal section of the one or more second wells above the horizontal section of the one or more first wells as viewed from a longitudinal-elevation side-view; establishing at least one channel from the horizontal section of each of the one or more first wells toward the horizontal section of the one or more second wells; injecting a fluid into the mineral-bearing deposit from the horizontal section of the one or more first wells adjacent to each of the at least one channels to form one or more slots; recovering brine from the formation through the horizontal section of the one or more second wells to form a cavity in the deposit; injecting a salt solution into the cavity from the horizontal section of the one or more second wells to cause selective dissolution of the target mineral; recovering a target mineral-enriched solvent from the horizontal section of the one or more first wells; and recovering the target mineral from the target mineral-enriched solvent. In various embodiments, the one or more slots are vertical slots. In various embodiments, the target mineral is dissolved from the exposed surface of the walls of the one or more slots in the cavity.

In various embodiments, the methods described herein are selective mining methods and processes for potash and/or other target minerals. The term "selective mining" refers to a process for dissolving a target mineral from a deposit over some period of time without, at the same time, dissolving all of the salt associated therewith. For example, the term "selective mining for potash" refers to a process, system or method for dissolving KCl from a sylvinite deposit over some period of time without, at the same time, dissolving all of the salt associated therewith.

Under solution mining conditions, selective solution mining of KCl on the side walls of a cavity proceeds at a slower rate than the rate of nonselective solution mining of the entire saline layer. If KCl is mined non-selectively, the cavity is enlarged, thereby risking a cave-in of the cavity and possibly a surface subsidence. With selective mining of KCl, only KCl is removed, and the cavity is not enlarged. Rather, a porous salt layer surrounding the cavity is formed. In various embodiments, a brine solution may be used to only remove KCl from the cavity. Selective mining also avoids the need to dispose of large quantities of salt brine after removal of the KCl since brine from which the KCl has been removed can be recycled back to the cavity/cavities for further enrichment with KCl through further selective mining. Since the potash loading may be considerably higher for brines recovered from selective mining, the size of the cooling and crystallizing equipment for a given output can be reduced.

An embodiment of a method for recovering a target mineral from a mineral-bearing deposit 10 is shown in FIG. 1. One or more first wells 12 and one or more second wells 14 have been drilled in the mineral-bearing deposit. In the embodiment shown in FIG. 1, two first wells 12 are shown with one second well 14. However, the methods described herein are not limited by the number or configuration of the one or more first wells and the one or more second wells 12 and 14. Any number of wells may be drilled in the mineral-bearing deposit 10 in order to maximize recovery therefrom. For example, one first well 12 and one second well 14 may be drilled in the mineral-bearing deposit 10. Alternatively, two first wells 12 and one second well 14 may be drilled in the mineral-bearing deposit 10. The number of first and second wells depends on the nature of the deposit in order to maximize recovery of the target mineral. Likewise with respect to configuration, the methods described herein are not limited to any particular configuration of the one or more first wells 12 and the one or more second wells 14. For example, the wells may be positioned in parallel rows as shown in the Figures, in a perpendicular or angled configuration, or in a circular configuration. The configuration used for any given mineral-bearing deposit 10 depends on the characteristics of the deposit as would be understood by a person of ordinary skill in the art in order to maximize the recovery of the target mineral therefrom.

Figure 2:
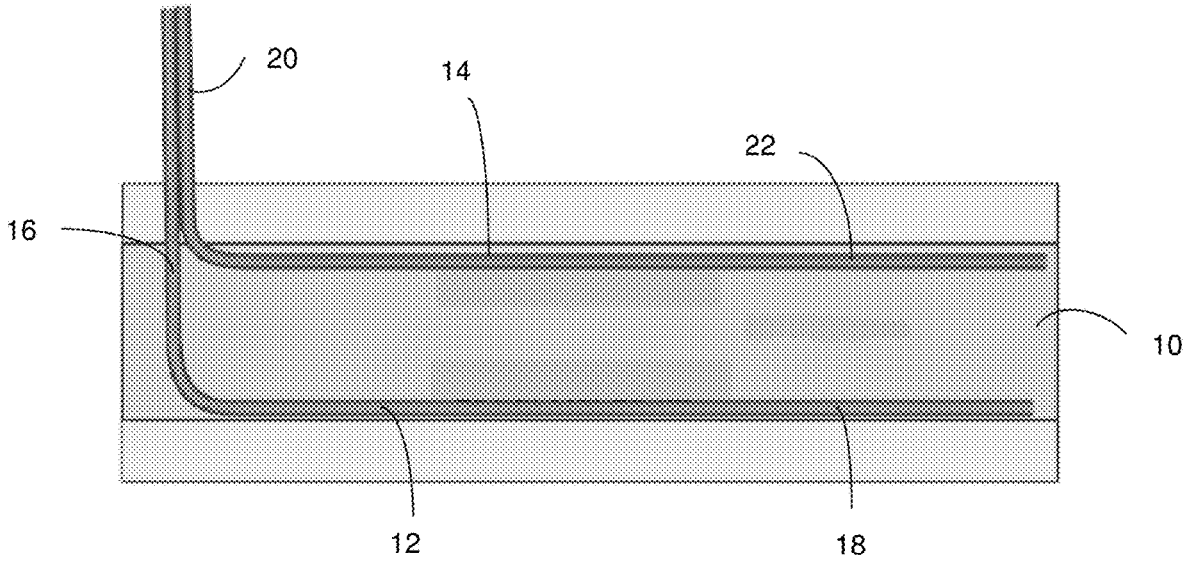
FIG. 2 is a longitudinal-elevation side-view of a well arrangement for a method according to a further embodiment of the invention.

In various embodiments, the one or more first wells 12 may be drilled from a same side of the mineral-bearing deposit 10 or from different sides of the mineral-bearing deposit 10. In various embodiments, the one or more second wells 14 may be drilled from a same side of the mineral-bearing deposit 10 or from different sides of the mineral-bearing deposit 10. For example, in the embodiment shown in FIG. 1, the one or more first wells 12 are drilled from a same side of the mineral-bearing deposit 10, which is an opposite side from which the second well 14 is drilled. In the embodiment of FIG. 2, the one or more first wells 12 and the one or more second wells 14 are drilled from the same side of the mineral-bearing deposit 10.

The one or more first wells 12 have a substantially vertical section 16 and a substantially horizontal section 18. The one or more second wells 14 also have a substantially vertical section 20 and a substantially horizontal section 22. The horizontal sections 18 of the one or more first wells 12 are vertically off-set from the horizontal sections 22 of the one or more second wells 14 such that the horizontal sections 22 of the one or more second wells 14 are above the horizontal sections 18 of the one or more first wells 12 as viewed from a longitudinal-elevation side-view as shown in FIG. 2. The one or more first wells 12 may be parallel, as shown in FIGS. 1 and 2, or may be vertically off-set from each other. In various embodiments, the one or more first wells 12 may be angled upward from heel to toe, so that the target-mineral enriched solvent produced in the cavity as KCl dissolves may flow down the slope toward the substantially vertical section 16 of the one or more first wells 12. In various embodiments, the heel of the one or more first wells 12 may be positioned below the mineral-bearing deposit 10.

In various embodiments, the horizontal section 18 of the one or more first wells 12 is at or adjacent to a bottom of the mineral-bearing deposit 10 and/or the horizontal section 22 of the one or more second wells 14 is at or adjacent to a top of the mineral-bearing deposit 10, as shown in FIG. 2.

Figure 3:
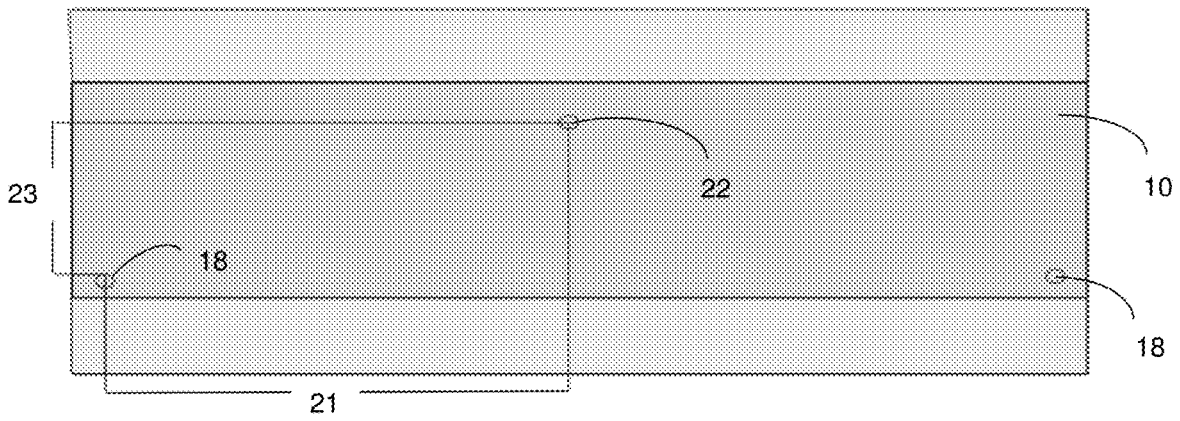
FIG. 3 is a lateral-elevation side-view of the well arrangement of FIG. 1.

The horizontal section 18 of the one or more first wells 12 may also be horizontally off-set from the horizontal section 22 of the one or more second wells 14 as viewed from a lateral-elevation side-view, as shown in FIGS. 1 and 3, or the horizontal section 18 of the one or more first wells 12 may be substantially parallel with the horizontal section 22 of the one or more second wells 14.

The vertical section 16 of the one or more first wells 12 and the vertical section 20 of the one or more second wells 14 extend from the surface of the ground to the desired level in the deposit. The horizontal section 18 of the one or more first wells 12 and the horizontal section 22 of the one or more second wells 14 may be at least about 100 m in length. For example, the horizontal section 18 of the one or more first wells 12 and the horizontal section 22 of the one or more second wells 14 may be about 200 m, about 300 m, about 400 m, about 500 m, about 600 m, about 700 m, about 800 m, about 900 m, about 1000 m, about 1100 m, about 1200 m, about 1300 m, about 1400 m, about 1500 m, about 1600 m, about 1700 m, about 1800 m, about 1900 m, about 2000 m, about 2100 m, about 2200 m, about 2300 m, about 2400 m, about 2500 m, about 2600 m, about 2700 m, about 2800 m, about 2900 m, about 3000 m, or longer, or any length therebetween. In various embodiments, the horizontal section 18 of each of the one or more first wells 12 and each of the horizontal section 22 of the one or more second wells 14 may have the same or different lengths.

As shown in FIG. 3, the lateral spacing 21 between the horizontal section 18 of the one or more first wells 12 and the horizontal section 22 of the one or more second wells 14 may be between about 100 m and about 1000 m, or any distance therebetween. In various embodiments, the angle of the at least one channel may depend on the lateral spacing, as described below. The lateral spacing between two horizontal sections 18 of two first wells 12 may be between about 200 m and about 2000 m, or any distance therebetween. The vertical spacing 23 between the horizontal section 18 of a first well 12 and the horizontal section 22 of a second well 14 depends on the thickness of the deposit being mined. In various embodiments, the heel of the one or more first wells 12 may be located below the deposit 10, with the toe of the one or more first wells 12 extending into the deposit 10. The lateral spacing between two horizontal sections 22 of two second wells 14 depends on the lateral spacing of the horizontal sections 18 of two first wells 12. In various embodiments, wells are spaced apart so that the portions of the cavity formed from each channel do not overlap, as described in further detail below.

Figure 4:
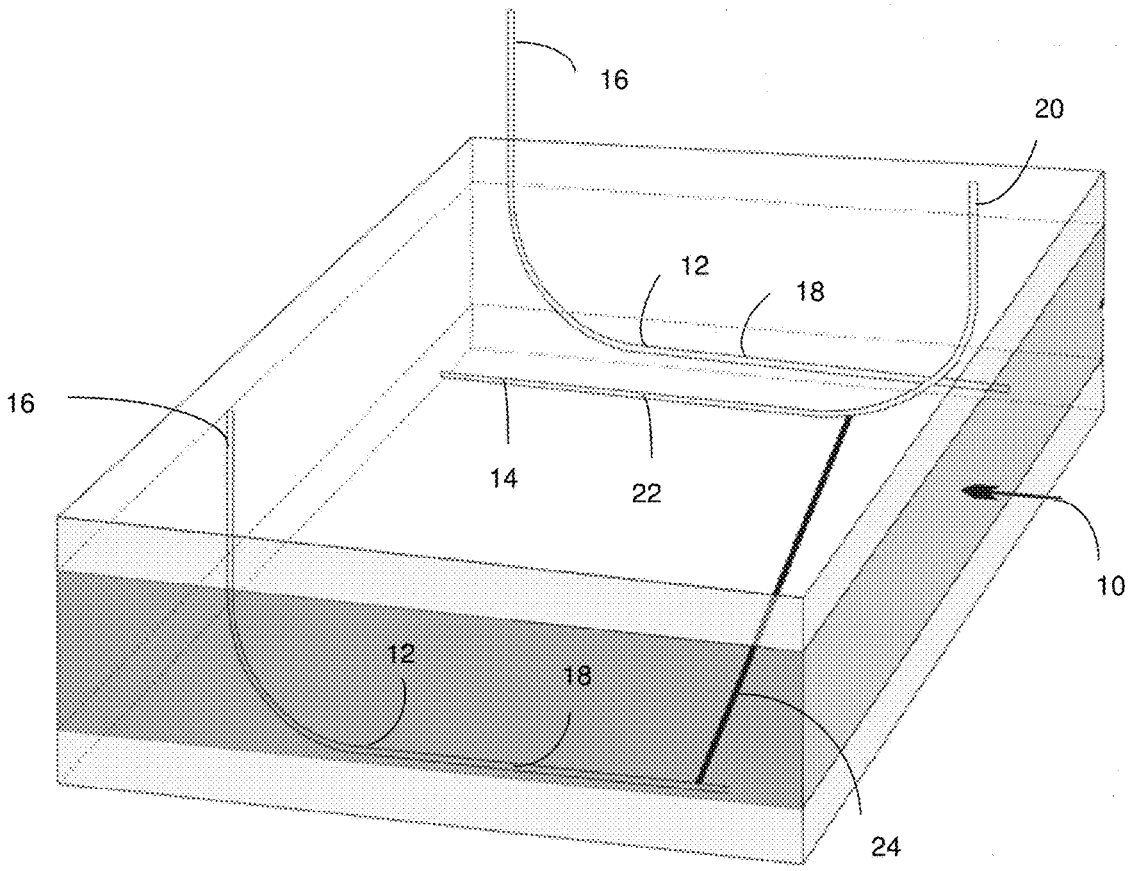
FIG. 4 is a perspective view of a well arrangement for a method according to an embodiment of the invention showing at least one channel.
Figure 5:
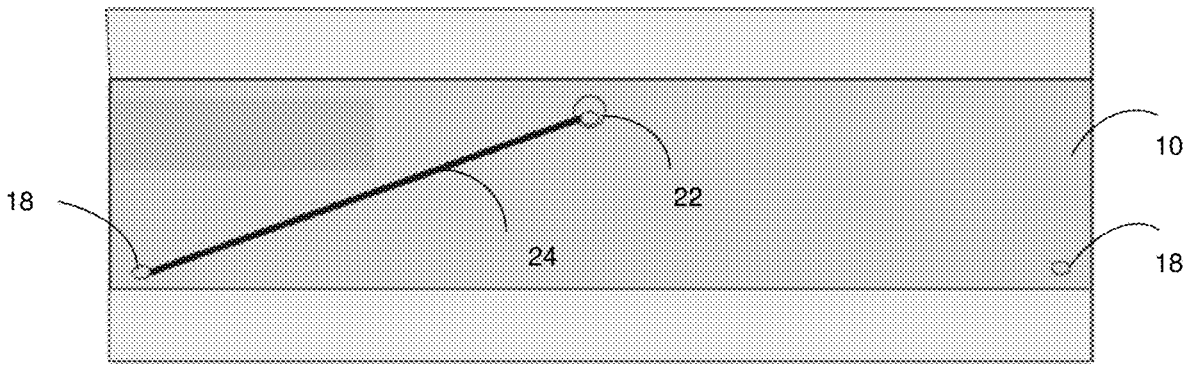
FIG. 5 is a lateral-elevation side-view of the well arrangement of FIG. 4.
Figure 6:
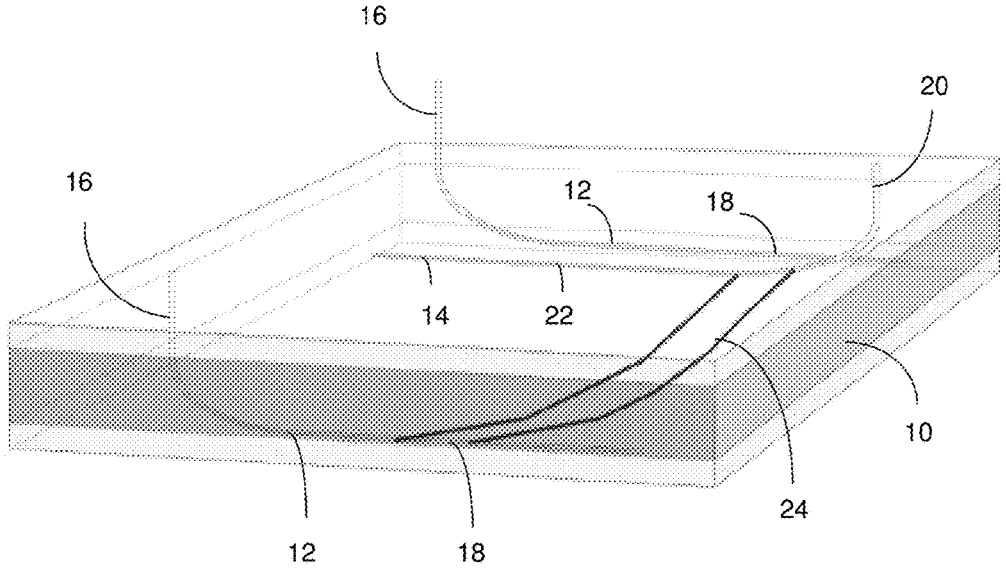
FIG. 6 is a perspective view of a well arrangement for a method according to an embodiment of the invention showing an alternative configuration for the at least one channel.
Figure 7:
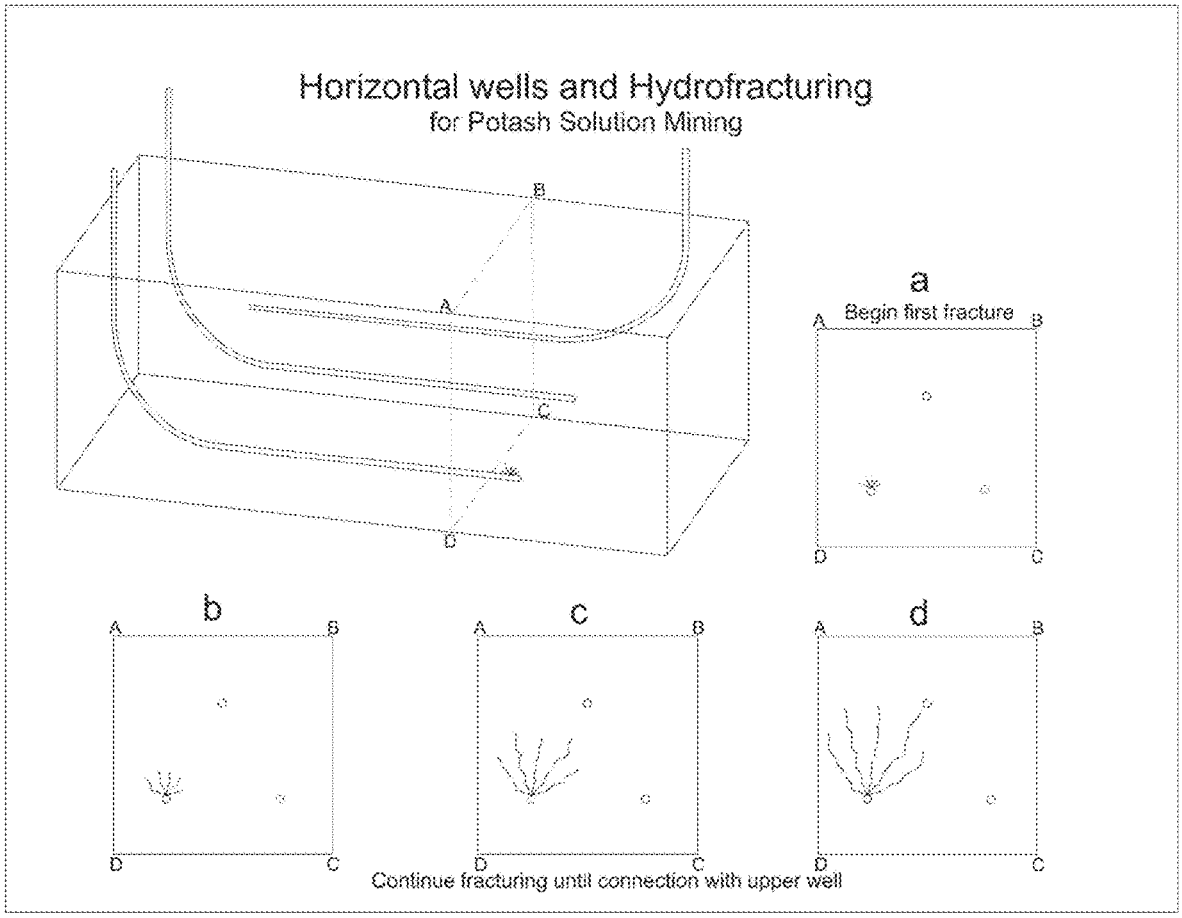
FIG. 7 shows a perspective view of a well arrangement for a method according to an embodiment of the invention and a lateral elevation side-view of a growth pattern (a-d) of fractures in a mineral-bearing deposit, the factures forming the at least one channel according to an embodiment of a method of the invention. The fractures are initiated (a) from a horizontal section of a first well, (b) and (c) show propagation of the fractures, and (d) shows that communication is established with a horizontal section of a second well.

At least one channel 24 from the horizontal section 18 of the one or more first wells 12 toward the horizontal section 22 of the one or more second wells 14 is established as shown in FIGS. 4 and 5. The at least one channel 24 establishes communication between the horizontal section 18 of the one or more first wells 12 and the horizontal section 22 of the one or more second wells 14. The at least one channel 24 may be established according to any method as would be known to a person of ordinary skill in the art. For example, the at least one channel 24 may be a directionally drilled borehole. The directionally drilled borehole is drilled from the horizontal section 18 of the first well 12 towards the horizontal section 22 of a second well 14. The borehole may be drilled close to the horizontal section 22 of the second well 14 and then communication with the horizontal section 22 of the second well 14 is established by injection of water from the borehole toward the horizontal section 22 of the second well 14. The at least one channel 24 may be of any angle or configuration as would be known to a person of ordinary skill in the art provided that communication between the horizontal section 18 of the one or more first wells 12 and the horizontal section 22 of the one or more second wells 14 is established. An example of a configuration of the at least one channel 24 is shown in FIG. 6, which shows two channels 24. The at least one channel 24 may extend from the horizontal section 18 of the one or more first wells 12 at a shallow angle relative to the horizontal section 18 and then increase in angle towards the horizontal section 22 of the second well 14. Alternatively, the at least one channel 24 may be a fracture which results from hydrofracturing the mineral-bearing deposit from the horizontal section 18 of the one or more first wells 12. An example of fractures generated from the horizontal section 18 of the one or more first wells 12 and their growth pattern from a-d is shown in FIG. 7. The fractures may be initiated from perforations in the horizontal section 18 of the one or more first wells 12 and their propagation continued through the deposit 10 to establish communication with the horizontal section 22 of the one or more second wells 14, as would be understood by a person of ordinary skill in the art.

The first channel of the at least one channel 24 may be drilled from a toe of the horizontal section 18 of the first well 12. Subsequent channels are then drilled from a position toward a heel of the horizontal section 18 of the first well 12.

In other embodiments, the channels 24 may be established from the heel of the first well 12 toward the toe of the first well 12. The distance between channels 24 along the horizontal section 18 of the first well 12 may be between about 25 m and about 200 m or any distance therebetween. For example, the distance between channels may be about 50 m, about 75 m, about 100 m, about 125 m, about 150 m or about 175 m. In various embodiments, the distance between channels 24 is set so that portions of the cavity created from each channel 24 do not overlap. A sufficient distance between channels 24 is maintained to ensure the selective dissolution of the target mineral from one channel does not intersect with the selective dissolution of the target mineral from another channel.

A fluid is then injected into the mineral-bearing deposit 10 from the horizontal section 18 of the one or more first wells 12 adjacent to each of the at least one channels 24 to form one or more slots. The one or more slots may be vertical slots, each of the one or more slots extends vertically from the horizontal section 18 of the one or more first wells 12. In various embodiments, the fluid comprises water. In various embodiments, the fluid consists of water. In various embodiments, and advantageously, the fluid does not utilize a roof control fluid such as one or more of various hydrocarbons, including, for example, oil, diesel fluid, crude oil, etc. The use of roof control fluids is an environmental liability and disadvantage associated with conventional solution mining methods. The fluid may be injected into the deposit 10 in any direction so as to establish a cavity within the mineral-bearing deposit 10, as described in further detail below. For example, the fluid may be injected into the deposit 10 in a direction perpendicular to the horizontal section 18 of the one or more first wells 12. The fluid may be injected into the deposit 10 toward the horizontal section 22 of the one or more second wells 14. Alternatively, the fluid is injected into the deposit 10 vertically toward the ground surface.

The injection of the fluid into the deposit 10 dissolves the salts in the deposit 10. In various embodiments, the fluid is substantially less than saturated in the minerals to be dissolved to form the cavity or a portion of the cavity 25 (see FIG. 8). For example, in a deposit for potash, the deposit contains substantial amounts of NaCl. The fluid injected into the deposit to form the slots must be low in saturation with respect to the salts in the deposit. In various embodiments, the fluid is water or naturally occurring brackish water (such as, for example, water obtained directly from a water well). Brine is recovered from the deposit 10 through the horizontal section 22 of the one or more second wells 14 to form a cavity or a portion of the cavity 25 in the deposit 10. This method of creating channels followed by slots and then recovering brine from the deposit increases the mineable surface area in the cavity.

This is in contrast to other prior art methods such as those disclosed in U.S. Pat. Nos. 9,260,918 and 8,899,691. These patents disclose methods for solution mining evaporite minerals, such as trona, by first drilling at least one access well into an evaporite mineral formation and then drilling at least two lateral boreholes which directly communicate with each other and at least one of the lateral boreholes is connected to at least one access well. An access well is defined as a conduit for which fluid is conducted into and out from the lateral boreholes or the cavities that result from solution mining the lateral boreholes. Lateral boreholes have at least a portion of the borehole that is mineable or leachable and extends through an evaporite mineral or permeable ore mineral formation, from where the drill branched out from another borehole (lateral or access) until either the end of the drilling or until another branching occurs. In contrast, the methods and systems of the present disclosure include at least one channel extending from the horizontal section of each of the one or more first wells to the horizontal section of the one or more second wells and no salt solution is injected into the cavity in the deposit from the at least one channel. Selective mining of the target mineral is not conducted from the at least one channel but instead, from the horizontal section of the one or more second wells. Furthermore, U.S. Pat. Nos. 9,260,918 and 8,899,691 do not disclose systems or methods where a fluid is injected into the mineral-bearing deposit to selectively produce a non-target mineral dissolved in solution, such as brine, that is removed through the horizontal section of the one or more second wells, in order to form a cavity. Formation of the cavity in the mineral-bearing deposit as described herein increases the mineable surface area of the deposit, thereby increasing recovery of the target mineral.

Figure 8:
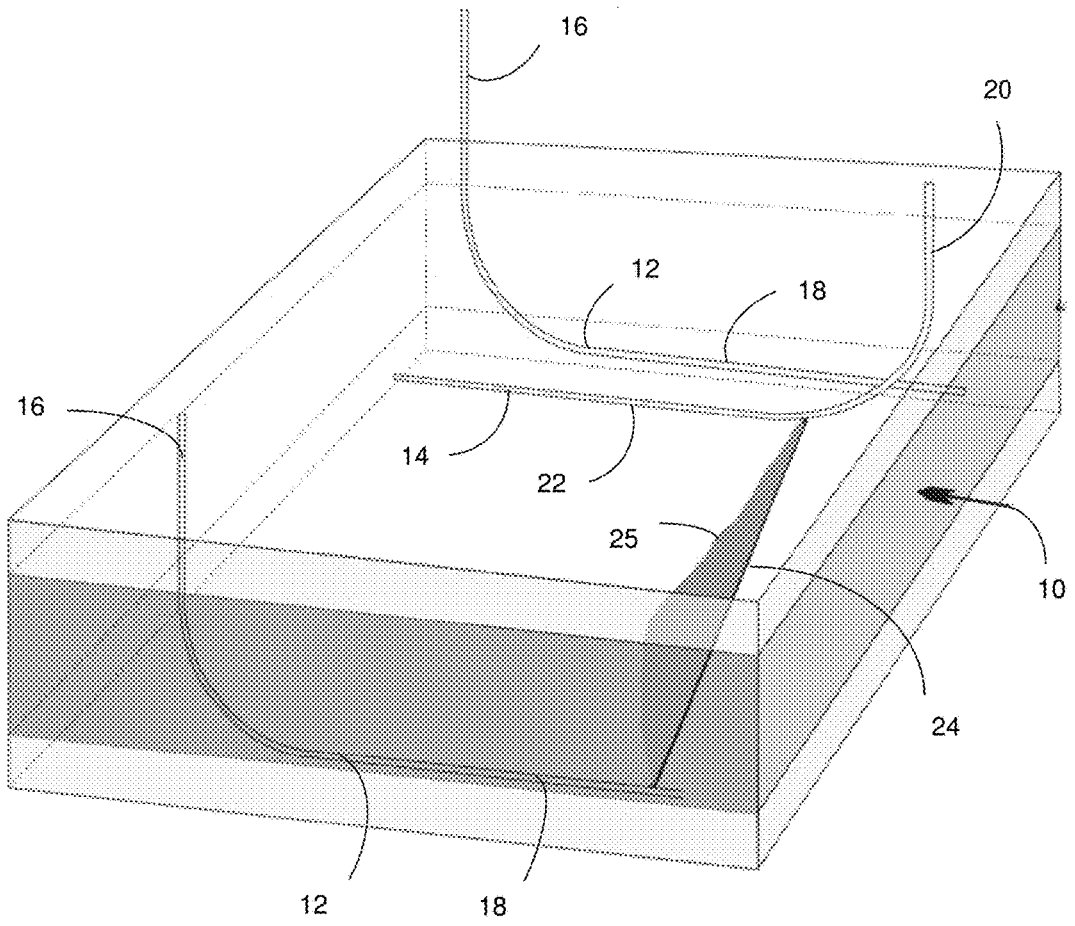
FIG. 8 is a perspective view of a well arrangement for a method according to an embodiment of the invention showing formation of a portion of a cavity in the deposit.
Figure 9:
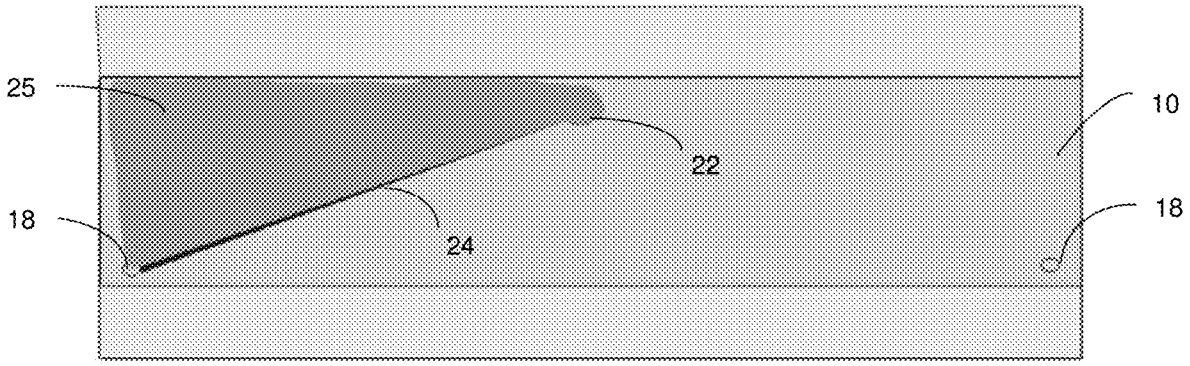
FIG. 9 is a lateral-elevation side-view of the well arrangement of FIG. 6.

The formation of a cavity is shown in FIGS. 8 and 9, the darker grey shading indicating a portion of the cavity 25 that is formed as brine is recovered from the horizontal section 22 of the one or more second wells 14. The composition of the brine recovered from the deposit may comprise substantially NaCl, but will typically reflect the ore grade of the deposit in which the slot is formed. In various embodiments, there is no overlap in portions of the cavity established from each channel 24 and associated slot, and the channels, slots and portions of the cavity are non-communicating.

Figure 10:
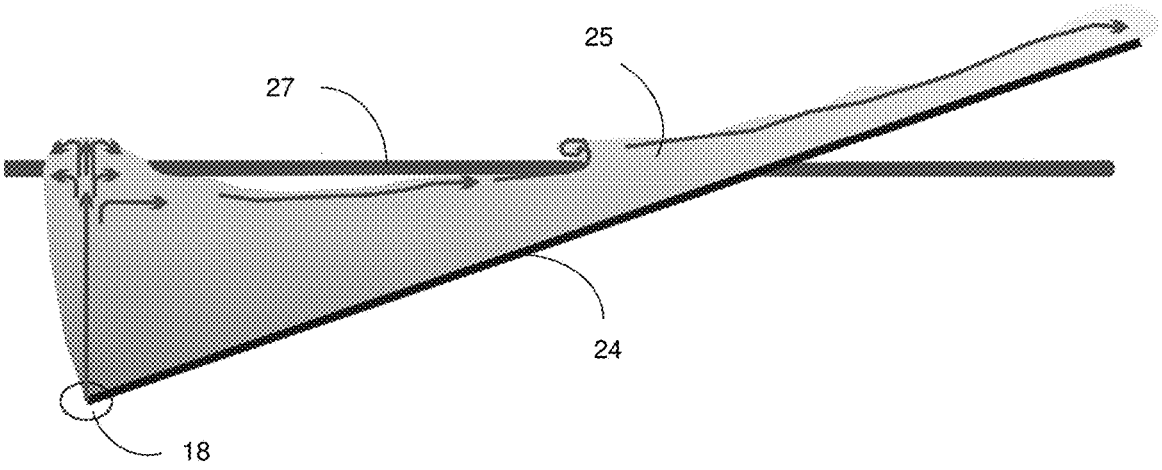
FIG. 10 is a lateral-elevation side-view showing flow of fluid through the deposit following injection of the fluid from the horizontal section of the one or more first wells adjacent to the at least one channel to form one or more slots and then a cavity of a portion of the cavity.

FIG. 10 shows a schematic of a flow pattern of the fluid following injection into the deposit from the horizontal section 18 of the one or more first wells 12. Due to buoyancy of the fluid in the deposit, the fluid migrates toward the top of the deposit and towards the horizontal section 22 of the one or more second wells 14. If there are any clay seams 27 in the deposit, the fluid migrates around these clay seams, either above or below, in order to create the cavity or portion of the cavity 25.

Figure 11:
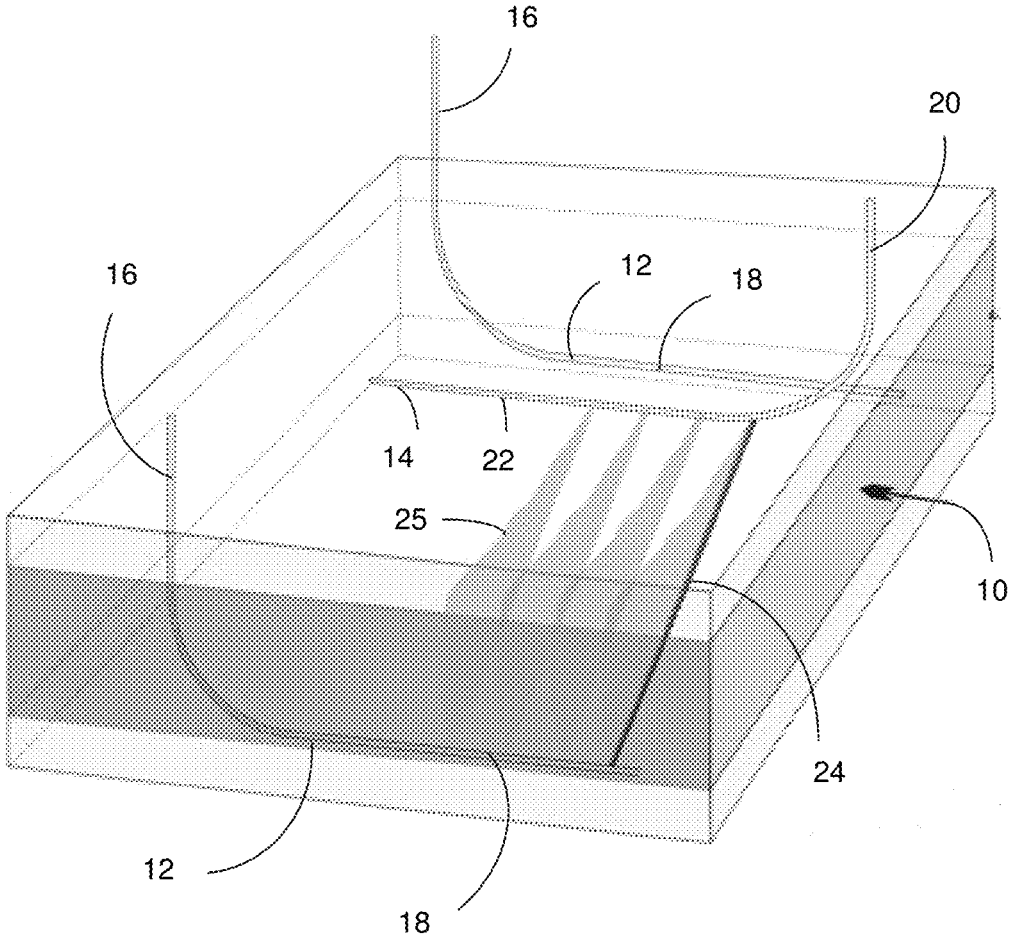
FIG. 11 is a perspective view of a well arrangement for a method according to an embodiment of the invention showing formation of portions of the cavity in the deposit. In various embodiments, the portions do not overlap one another.

In embodiments where there are two or more channels 24 in the deposit 10, the slot and portion of the cavity associated with each of the channels may be formed before the next channel is established, as shown in FIG. 11. Alternatively, all of the channels 24 may be established and then each slot is formed.

Figure 12:
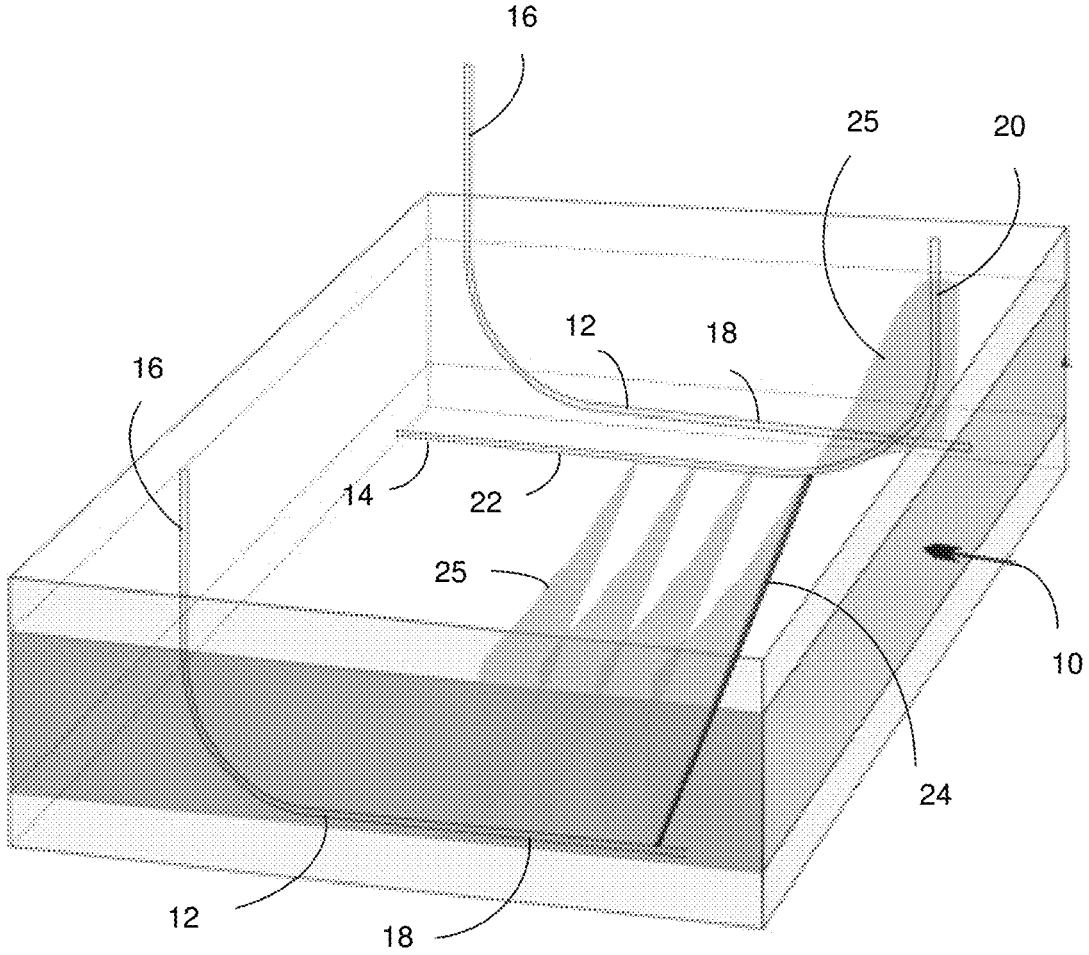
FIG. 12 is a perspective view of a well arrangement for a method according to an embodiment of the invention showing formation of further portions of the cavity in the deposit.
Figure 13:
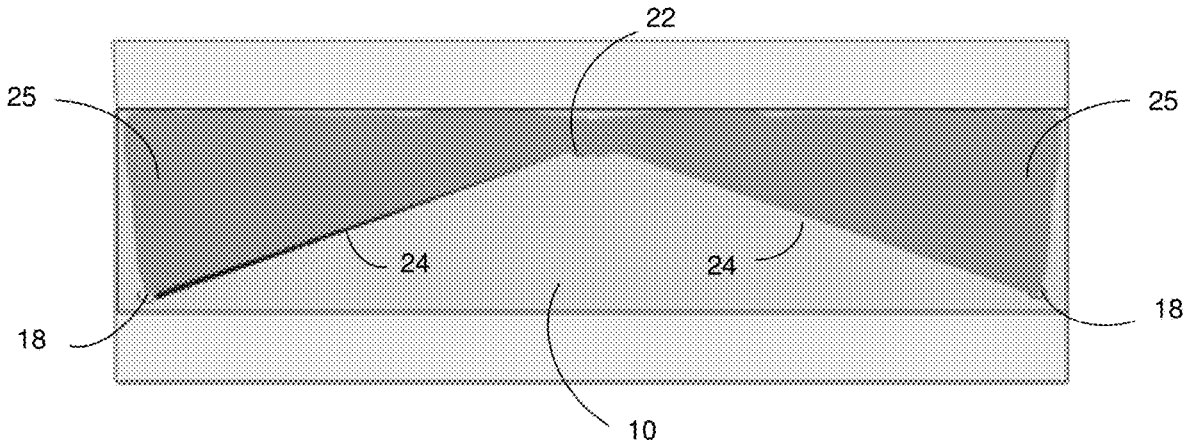
FIG. 13 is a lateral-elevation side-view of the well arrangement of FIG. 10.

An embodiment of the methods described herein is shown in FIGS. 12 and 13 where two first wells 12 and one second well 14 are drilled in the deposit 10. As each channel 24 is formed in the deposit, the slot and portion of the cavity are formed before establishing the next channel 24. When all of the channels 24 and slots are established along one first well 12, at least one channel 24 and at least one slot are formed on the other first well 12. Channels 24 from both of the first wells 12 are in communication with the same second well 14. As brine is recovered from the horizontal section of the second well 14 following injection of the fluid into the deposit 10 from the one or more first wells 12, the cavity 25 is formed, portions of which are shown with darker shading in the Figures.

Figure 14:
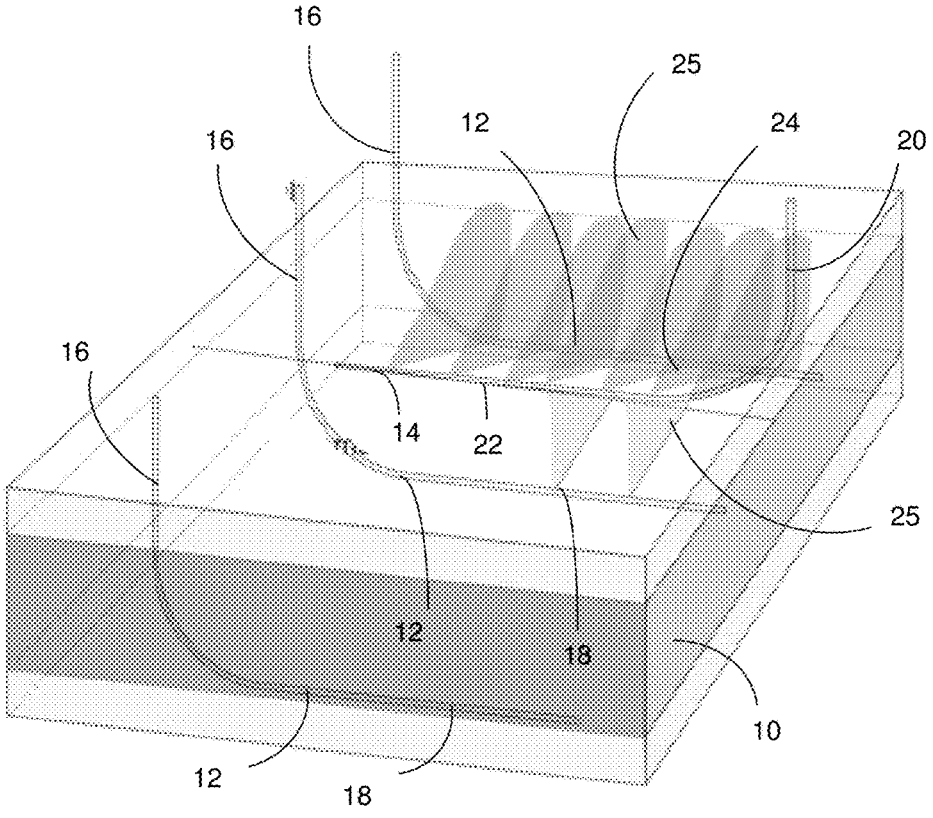
FIG. 14 is a perspective view of a well arrangement for a method according to an embodiment of the invention showing formation of portions of the cavity in the deposit. The well configuration comprises three first wells and one second well.
Figure 15:
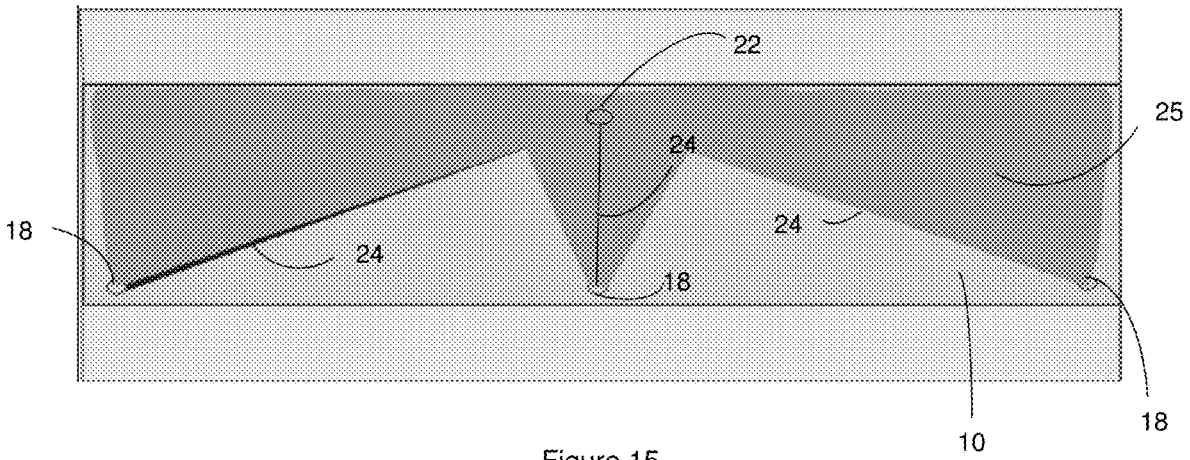
FIG. 15 is a lateral-elevation side-view of the well arrangement of FIG. 12.

An alternative embodiment is shown in FIGS. 14 and 15 where three first wells 12 and one second well 14 are drilled in the deposit 10. One of the first wells 12 is substantially parallel with and below the second well 14 while the other two first wells 12 are laterally spaced apart as viewed from a lateral-elevation side-view. There are multiple channels 24 extending from the horizontal section 18 of each first well 12 and in communication with the horizontal section 22 of the second well 14. As the brine is removed from the horizontal section 22 of the second well 14, the cavity or portion of the cavity 25 is formed.

Figure 16:
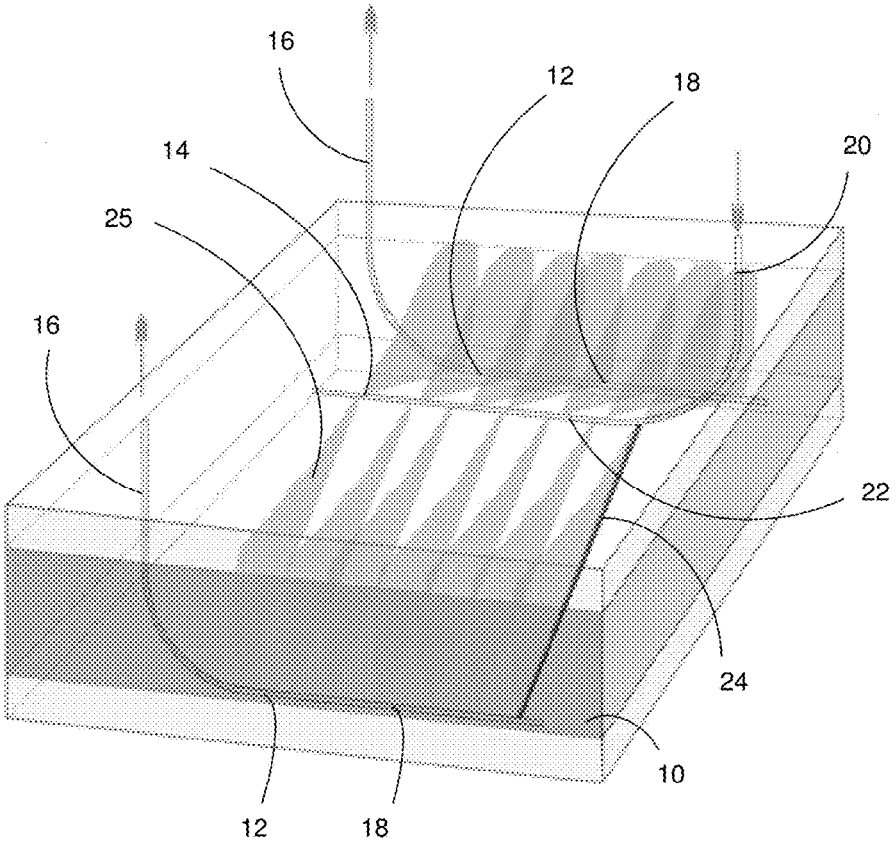
FIG. 16 is a perspective view of a well arrangement for a method according to an embodiment of the invention showing formation of a cavity in the deposit with a target-mineral enriched solvent being recovered from the horizontal section of the one or more first wells. The well configuration comprises two first wells and one second well.

In various embodiments, the term "cavity" refers to the entire area of the mineral-bearing deposit that the target mineral is selectively mined from, and includes the at least one channel 24, the slots and the area of the deposit 10 that contains these elements, and the portions of the cavity established from each slot. An example of an embodiment of a cavity is shown in FIG. 16.

Once the cavity is created, the target mineral, such as KCl, may be recovered. A salt solution is injected into the cavity. This salt solution dissolves KCl as it percolates down through the cavity. As the target mineral is selectively dissolved, the cavity is not enlarged, but rather, becomes more porous. A target mineral-enriched solvent is recovered from the horizontal section 18 of the one or more first wells 12, as shown in FIG. 16.

Solvent, such as a salt solution, is introduced through the horizontal section 22 of the one or more second wells 14 near the top of the cavity. The solvent may be fresh water or the salt solution may be partially or fully saturated with salt. In various embodiments, the solvent is at least partially unsaturated with respect to KCl. In various embodiments, the salt solution is saturated, or nearly saturated, with respect to NaCl. If the solvent is not saturated with NaCl, it will dissolve NaCl at the top of the cavity following introduction through the horizontal section 22 of the one or more second wells 14 and will become saturated, thereby ensuring selective dissolution of the KCl in the cavity. This dissolution of NaCl to saturate the solvent will result in at least some enlargement of the cavity.

Figure 17:
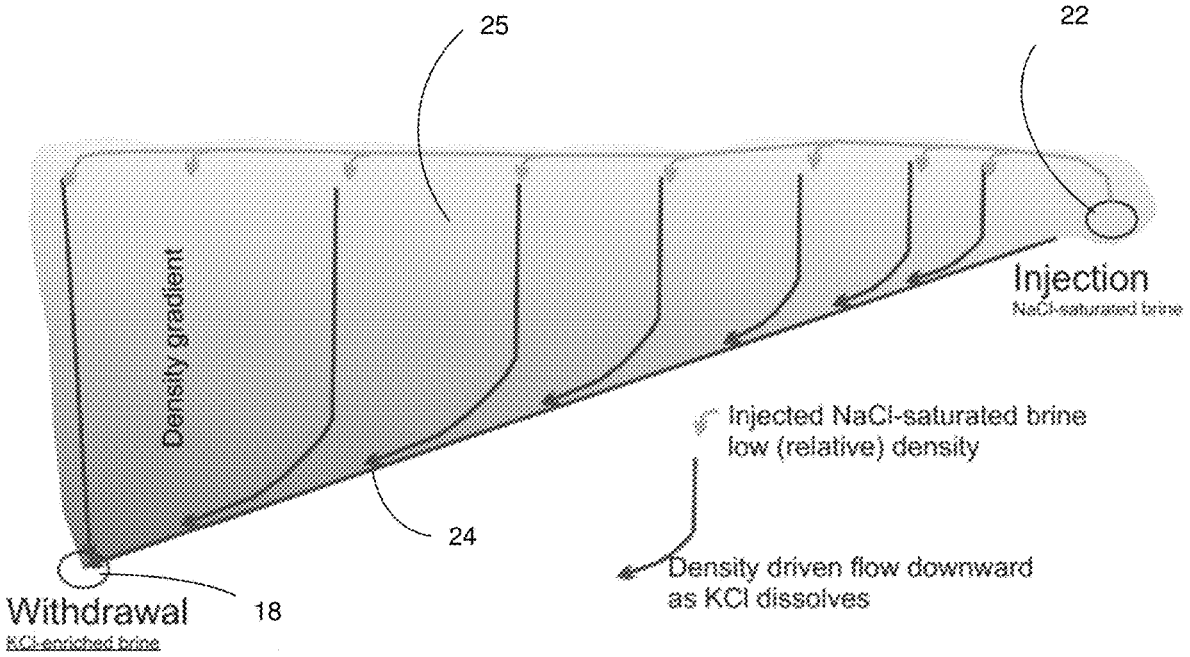
FIG. 17 is a lateral-elevation side-view showing flow of target mineral-enriched solvent from the horizontal section of the one or more second wells to the horizontal section of the one or more first wells.

The salt solution pumped into the top of the cavity 25 will have a lower specific gravity and lower density than the solvent lower in the cavity 25 (which has a higher density) and will therefore spread out more or less horizontally before beginning its downward percolation, as shown in FIG. 17. The solvent, upon entering the cavity, if not already saturated with salt, will become saturated with salt. This may result in some enlargement of the cavity. Thereafter, the solvent will selectively take KCl into solution with some resulting precipitation of salt from solution. As a result, the cavity is not enlarged, but becomes more porous. The large surface area of the cavity enables the solvent to selectively dissolve KCl at an acceptable circulation rate and the solvent will move toward the one or more first wells 12 as a result of a density gradient from the top of the cavity 25 toward a bottom of the cavity 25. In various embodiments, the target mineral-enriched solvent will flow into the at least one channel 24, before being collected in the horizontal section 18 of the one or more first wells 12 and pumped to the surface. The difference in density between the top and bottom of the cavity 25 will drive the flow of salt solution down towards the horizontal section 18 of the one or more first wells 12.

In various embodiments, the method may further comprise heating the salt solution prior to injection into the deposit 10. Heating the salt solution may increase the solubility of KCl in the salt solution, thus producing a more concentrated target mineral-enriched solvent. The salt solution may be heated to the same temperature as the deposit or may be heated to a much greater temperature than the deposit, even as high as 100° C.

In various embodiments, the flow rate of the salt solution through the deposit depends on the mineable surface area in the cavity which provides an acceptable target mineral concentration in the target mineral-enriched solvent. For example, the flow rate may be 10 cubic meters per hour ($m^3$/hr), 20 $m^3$/hr, 50 $m^3$/hr, 100 $m^3$/hr, greater than 100 $m^3$/hr, or any flow rate therebetween. The flow rate may depend on the mineable surface area of the deposit, the temperature of the deposit, the concentration of the solvent, the ore grade of the target mineral, and the temperature of the solvent, amongst other parameters known to those of ordinary skill in the art.

EXAMPLE 1: KCL RECOVERY MODELING

This example demonstrates how recovery of a target mineral from a deposit may be improved using the methods described herein. The methods described herein increase the available or mineable surface area in a deposit.

The parameters shown in Table 1 were modeled, based on a model where two first wells and one second well are drilled in a typical southern Saskatchewan potash deposit. The deposit generally consists of a lower potash bed called the Esterhazy Bed which is about 5 m to about 6 m thick, followed (upward) by a thick, low grade section typically about 14 m to about 17 m thick. Above the low grade bed is the Belle Plaine Bed which is typically about 3 m to about 5 m thick, above that, the Patience Lake member which is about 10 m to about 12 m thick. Between the Belle Plaine Bed and the Patience Lake bed is a relatively thin, un-named low grade bed that is about 3 m to about 4 m thick. These thicknesses are for reference only as both the thicknesses and potash grade can vary between locations.

TABLE 1

Parameters for modeling an embodiment of a method as described herein

| | |
|---|---|
| Total number of first wells and second wells | 3 |
| Lateral distance between wells | 50 m |
| Total height of deposit | 15.12 m |
| Number of channels per first well | 16 |

A computer-based representation of the deposit and well configuration discussed in Table 1 was prepared. Data for generating computer-based representations can be obtained from a variety of methods, details of which will be understood by those of skill in the art.

The development of the cavity was modeled, and results from the simulation are shown in Table 2.

TABLE 2

Recovery of KCI from a deposit based on the parameters of Table 1 using an embodiment of a method as described herein

| | |
|---|---|
| Surface area developed in potash beds | 299,200 $m^2$ |
| KCI concentration in KCI-enriched solvent | 170 g/L |
| KCI production | 111,200 tonnes/year |

Another method of selectively mining potash from the Saskatchewan deposit was modeled for comparison to the results described above. This alternative method consists of a vertical well connected to a horizontal section 850 m in length at the bottom of the Belle Plaine Bed. A second vertical well is then drilled and connected to the first well at the point where the first well becomes horizontal. The horizontal portion of the well is enlarged by injecting water at the toe end of the horizontal well and returning solution through the horizontal section to where it is removed through the second vertical well.

TABLE 3

| Parameters for modeling an alternative method | |
|---|---|
| Total number of vertical wells | 6 |
| Total number of horizontal sections | 3 |
| Length of horizontal section | 850 m |
| Total height of beds | 5.3 m |
| Height of potash beds | 5.3 m |

Utilizing the same modeling techniques as described above, the results of this simulation are shown in Table 4.

TABLE 4

| Recovery of KCl from a deposit based on the parameters of Table 3 using an alternative method | |
|---|---|
| Surface area developed in potash beds | 27,030 $m^2$ |
| KCl concentration in KCl-enriched solvent | 170 g/L |
| KCl production | 10,046 tonnes/year |

Tables 2 and 4 show that the methods described herein can develop more than 10 times the available or mineable surface area compared to the alternative method and hence, more than 10 times the production of potash can be achieved, utilizing fewer vertical wells.

Another advantage of the methods disclosed herein relates to ore grade of the deposit to be mined. In prior methods, the selective mining of KCl requires an ore grade of greater than about 25% KCl. If the ore grade is less than about 25% KCl, then the KCl crystals in the ore are not contiguous (i.e. touching each other) and so dissolution of KCl cannot proceed. For example, the alternative method described above can only progress upward through a potash bed as long as the ore grade is greater than about 25% KCl. This method cannot be used to mine upwards through the low grade bed between the Esterhazy Bed and the Belle Plaine Bed, nor can alternative prior methods be used to mine upward through the low grade zone between the Belle Plaine Bed and the Patience Lake Bed. Furthermore, in many deposits, there are low grade zones or sub-beds within the Esterhazy Bed and the Belle Plaine Bed which will also stop the upward selective mining of the potash in the beds.

The methods described herein are not limited by ore grade in the deposit because the at least one channel is established through any low grade zones and sub-beds, thus giving access of the solvent to all beds greater than 25% KCl. Thus, compared to prior art methods, the methods as disclosed herein allow for greater recovery of the target mineral from a deposit than can be accomplished using other prior art methods utilizing horizontal wells at the bottom of the beds only.

Although various embodiments of the invention are disclosed herein, many adaptations and modifications may be made within the scope of the invention in accordance with the common general knowledge of those skilled in this art. Such modifications include the substitution of known equivalents for any aspect of the invention in order to achieve the same result in substantially the same way. Numeric ranges are inclusive of the numbers defining the range. The word "comprising" is used herein as an open-ended term, substantially equivalent to the phrase "including, but not limited to", and the word "comprises" has a corresponding meaning. As used herein, the singular forms "a", "an" and "the" include plural referents unless the context clearly dictates otherwise. Thus, for example, reference to "a thing" includes more than one such thing. Citation of references herein is not an admission that such references are prior art to the present invention. Any priority document(s) and all publications, including but not limited to patents and patent applications, cited in this specification are incorporated herein by reference as if each individual publication were specifically and individually indicated to be incorporated by reference herein and as though fully set forth herein. The invention includes all embodiments and variations substantially as hereinbefore described and with reference to the examples and drawings.

The invention claimed is:

1. A method for recovering a target mineral from a mineral-bearing deposit, the method comprising:

drilling one or more first wells and one or more second wells in the mineral-bearing deposit, the one or more first wells and the one or more second wells each having a substantially vertical section and a substantially horizontal section, the horizontal section of the one or more second wells vertically off-set from the horizontal section of the one or more first wells, the horizontal section of the one or more second wells above the horizontal section of the one or more first wells as viewed from a longitudinal-elevation side-view, and the horizontal section of the one or more second wells laterally off-set from the horizontal section of the one or more first wells, as viewed from a lateral-elevation side-view;

establishing at least one channel from the horizontal section of each of the one or more first wells toward the horizontal section of the one or more second wells;

injecting a fluid into the mineral-bearing deposit from the horizontal section of the one or more first wells adjacent to each of the at least one channels to form one or more slots, the one or more slots above the horizontal section of the one or more first wells as viewed from a longitudinal-elevation side-view;

recovering brine from the deposit through the horizontal section of the one or more second wells to form a cavity in the mineral-bearing deposit;

injecting a salt solution into the cavity from the horizontal section of the one or more second wells to cause selective dissolution of the target mineral;

recovering a target mineral-enriched solvent from the horizontal section of the one or more first wells; and recovering the target mineral from the target mineral-enriched solvent.

2. The method of claim 1, wherein the fluid is injected into the mineral-bearing deposit in a direction perpendicular to the horizontal section of the one or more first wells.

3. The method of claim 1, wherein each of the one or more slots extends vertically from the horizontal section of the one or more first wells.

4. The method of claim 1, wherein the target mineral is potash.

5. The method of claim 1, wherein the at least one channel is a directionally drilled borehole.

6. The method of claim 1, further comprising hydrofracturing the mineral-bearing deposit from the horizontal section of the one or more first wells, wherein the at least one channel is a fracture.

7. The method of claim 1, wherein one first well and one second well are drilled in the mineral-bearing deposit.

8. The method of claim 1, wherein two first wells and one second well are drilled in the mineral-bearing deposit and the second well is laterally between the two first wells as viewed from a lateral-elevation side-view.

9. The method of claim 1, wherein three first wells and one second well are drilled in the mineral-bearing deposit, one of the three first wells substantially underneath the second well as viewed from a lateral-elevation side-view.

10. The method of claim 1, wherein the one or more second wells is at or adjacent to a top of the mineral-bearing deposit.

11. The method of claim 1, wherein the one or more first wells is at or adjacent to a bottom of the mineral-bearing deposit.

12. The method of claim 1, wherein the fluid for forming the one or more slots consists of water.

13. The method of claim 1, wherein the fluid for forming the one or more slots does not include a roof control fluid.

14. The method of claim 1, wherein two or more channels are established in the deposit and portions of the cavity from the two or more channels are non-communicating.

15. The method of claim 1, wherein the salt solution is a saturated or near-saturated NaCl solution.

16. The method of claim 1, wherein the horizontal sections of the one or more first wells and the one or more second wells are parallel as viewed from the longitudinal elevation view.

17. The method of claim 1, wherein each of the at least one channels is in communication with the horizontal section of one of the one or more first wells and the horizontal section of one of the one or more second wells.

18. A system for recovering a target mineral from a mineral-bearing deposit, the system comprising:

one or more first wells and one or more second wells in the mineral-bearing deposit, the one or more first wells and the one or more second wells each having a substantially vertical section and a substantially horizontal section, the horizontal section of the one or more second wells vertically off-set from the horizontal section of the one or more first wells, the horizontal section of the one or more second wells above the horizontal section of the one or more first wells as viewed from a longitudinal-elevation side-view, and the horizontal section of the one or more second wells laterally off-set from the horizontal section of the one or more first wells, as viewed from a lateral-elevation side-view;

at least one channel extending from the horizontal section of each of the one or more first wells toward the horizontal section of the one or more second wells;

a fluid for injecting into the mineral-bearing deposit from the horizontal section of the one or more first wells adjacent to each of the at least one channels to form one or more slots, wherein the one or more slots are above the horizontal section of the one or more first wells as viewed from a longitudinal-elevation side-view, and wherein the fluid dissolves salt and brine is recovered from the mineral-bearing deposit through the horizontal section of the one or more second wells, thereby forming a cavity in the mineral-bearing deposit; and a salt solution for injecting into the cavity from the horizontal section of the one or more second wells to selectively dissolve the target mineral and form a target mineral-enriched solvent that is recovered from the horizontal section of the one or more first wells, wherein the target mineral is recovered from the target mineral-enriched solvent.

19. The system of claim 18, wherein the at least one channel is a directionally drilled borehole.

20. The system of claim 18, wherein each of the one or more slots extends vertically from the horizontal section of the one or more first wells.

* * * * *